US010499740B2

(12) United States Patent
Browne

(10) Patent No.: US 10,499,740 B2
(45) Date of Patent: Dec. 10, 2019

(54) FURNITURE LEG ATTACHMENT

(71) Applicant: Vincent Browne, Takoma Park, MD (US)

(72) Inventor: Vincent Browne, Takoma Park, MD (US)

( * ) Notice: Subject to any disclaimer, the term of this patent is extended or adjusted under 35 U.S.C. 154(b) by 0 days.

(21) Appl. No.: 16/162,345

(22) Filed: Oct. 16, 2018

(65) Prior Publication Data

US 2019/0110596 A1 Apr. 18, 2019

Related U.S. Application Data

(60) Provisional application No. 62/572,648, filed on Oct. 16, 2017.

(51) Int. Cl.

| | |
|---|---|
| ***A47B 91/00*** | (2006.01) |
| ***A47B 91/02*** | (2006.01) |
| ***A47B 91/16*** | (2006.01) |
| ***A47C 7/00*** | (2006.01) |

(52) U.S. Cl.

CPC ..... *A47B 91/02* (2013.01); *A47B 91/16* (2013.01); *A47C 7/008* (2013.01)

(58) Field of Classification Search

CPC ..... A47B 9/16; A47B 91/12; A47B 91/00; A47B 2091/007; A47L 9/02

See application file for complete search history.

(56) References Cited

U.S. PATENT DOCUMENTS

| | | | | | |
|---|---|---|---|---|---|
| 2,860,367 | A * | 11/1958 | Kolenda | A47L 9/02 | 15/393 |
| 2,875,552 | A * | 3/1959 | Stillman | A47B 91/04 | 248/188.9 |
| 2,888,022 | A * | 5/1959 | Fanning | A61H 3/0277 | 135/82 |
| 3,065,494 | A * | 11/1962 | Kramcsak, Jr. | A47B 91/066 | 16/42 R |
| 4,440,186 | A * | 4/1984 | Lottner | A45B 9/04 | 135/84 |
| 4,744,441 | A * | 5/1988 | Sandstrom | E06C 7/46 | 182/111 |
| 4,964,430 | A * | 10/1990 | Janis | A45B 1/00 | 135/67 |
| 5,010,621 | A * | 4/1991 | Bock | A47B 91/066 | 16/39 |
| 5,104,075 | A * | 4/1992 | Freeman | F16M 7/00 | 248/188.4 |

(Continued)

*Primary Examiner* — Amy J. Sterling

(57) ABSTRACT

The furniture leg attachment is an apparatus that is used to stabilize an uneven chair, table, or other piece of furniture. The apparatus is also configured to prevent sliding on rough or uneven surfaces, such as may be encountered during outdoor furniture use. The apparatus comprises a leg-receiving tube, a foot, a ball-and-socket joint, an incremental height-adjustment mechanism, and a plurality of ground-gripping protrusions. The leg-receiving tube connects to the foot by the ball-and-socket joint, which allows the foot to rotate and adjust relative to the surface that the table or chair is positioned upon. The incremental height-adjustment mechanism is part of the leg-receiving tube that allows the user to modify the height of the foot and the table or chair leg above the ground. The plurality of ground-gripping protrusions extends from the foot to grasp the surface that the present invention is upon.

20 Claims, 7 Drawing Sheets

(56) References Cited

U.S. PATENT DOCUMENTS 6,520,459 B2 * 2/2003 Burr ..... A47B 91/066
248/188.2
8,037,574 B2 * 10/2011 Chase ..... A47B 91/06
16/42 R

* cited by examiner

FURNITURE LEG ATTACHMENT

The current application claims a priority to the U.S. Provisional Patent application Ser. No. 62/572,648 filed on Oct. 16, 2017.

FIELD OF THE INVENTION

The present invention generally relates to a structural support and ground brace. More specifically, the present invention is a furniture leg attachment that allows a user to elongate a leg or legs of a chair, table, or similar furniture structure. The present invention is further equipped to prevent connected items from sliding on slanted or unsteady surfaces.

BACKGROUND OF THE INVENTION

Chairs and tables are commonplace items during camping, picnics, and similar outdoor activities. Unfortunately, most of the surfaces outdoors are not flat; most of the surfaces outdoors are uneven, with varying surfaces and textures. When a user places four-legged tables, chairs, or similar furniture on a slope, the body of the object tends to wobble about the two highest opposing legs, causing items placed on top of the object to slide and fall off the object.

The most common solution to this problem is to place a solid, somewhat flat object, such as a brick or rock, under a short leg of the furniture to level the body of the furniture. In this way, items or people situated on top of furniture do not slide and fall off the furniture. However, this simple solution is not reliable, as it is easy for someone to bump into the furniture or knock the brick or rock from under the leg of the furniture, rendering the added support useless. In addition, due to surfaces having different textures, such as grass or sand, it is hard to adequately level a furniture body and keep the furniture body leveled without the legs of the furniture shifting on the supports or on the ground. There is some newer furniture that includes length-adjustable legs which can be extended or shortened to level the furniture, but unfortunately, few items provide this feature. Another alternative is to use furniture leg extensions. While many available leg extensions help users level furniture on uneven surfaces, they generally do not provide a mechanism to prevent the furniture from slipping down the slope. What is needed is a furniture leg attachment which can be positioned under the legs of furniture to level furniture on uneven surfaces and simultaneously prevent the legs of the furniture from slipping down the slope of an uneven surface.

The present invention addresses these issues. An objective of the present invention is to provide a furniture leg attachment which provides a method of leveling the body of a furniture on an uneven surface. Another objective of the present invention is to provide a furniture leg attachment which can be easily attached to the legs of the furniture body. Further, a furniture leg attachment which provides attachments that prevent the legs of the furniture body from slipping down sloped surfaces is also achieved. The present invention utilizes a textured surface connected to a sleeve by a ball-and-socket joint to allow chair and table legs to connect and adjust to various surface slopes. The textured surface further prevents the present invention from sliding down angled slopes and surfaces. Additional advantages of the present invention will be obvious in part from the description or may be learned by practice of the invention. Further advantages may be realized and attained by means of the instrumentalities and combinations particularly pointed out in the detailed description of the invention section.

DETAILED DESCRIPTION OF THE INVENTION

All illustrations of the drawings are for the purpose of describing selected versions of the present invention and are not intended to limit the scope of the present invention.

Figure 1:
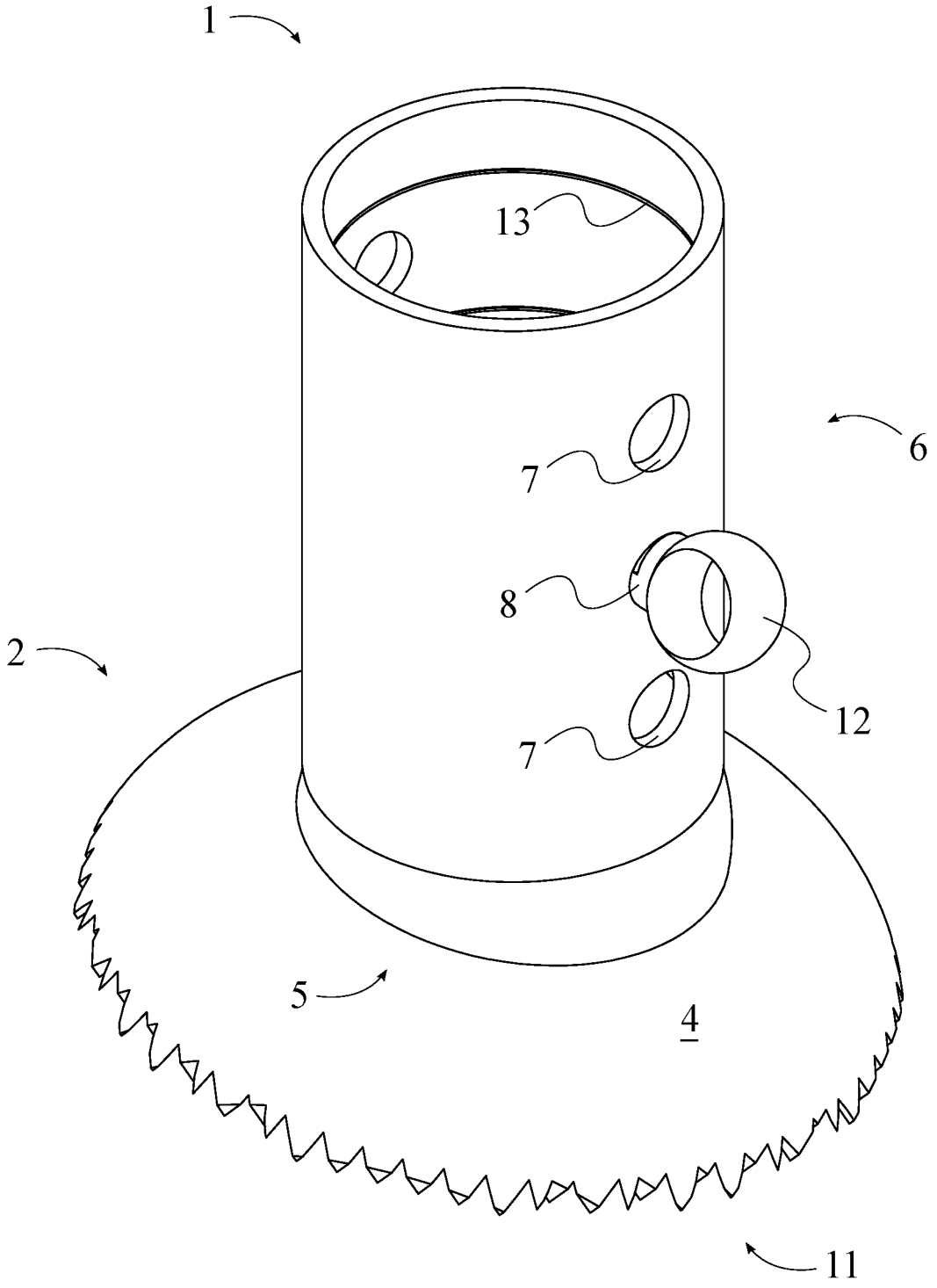
FIG. 1 is a top perspective view of the present invention.
Figure 3:
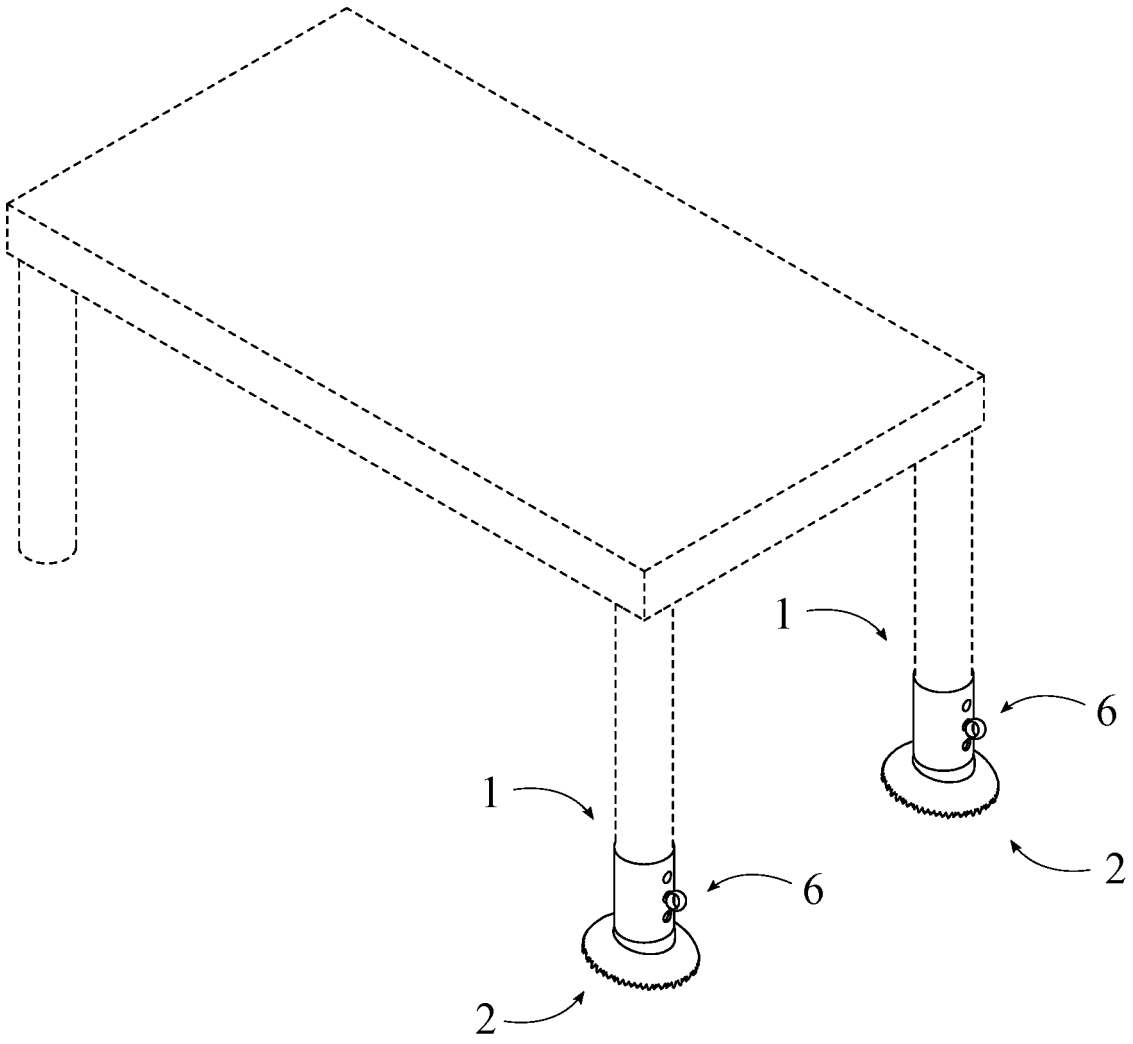
FIG. 3 is a top perspective view of an exemplary usage of the present invention.

The present invention is a furniture leg attachment that is used to stabilize an uneven chair, table, or other piece of furniture, as seen in FIG. 3. The present invention is also configured to prevent sliding on rough or uneven surfaces, such as may be encountered during outdoor furniture use. The present invention comprises a leg-receiving tube 1, a foot 2, a ball-and-socket joint 5, an incremental height-adjustment mechanism 6, and a plurality of ground-gripping protrusions 11, as seen in FIG. 1. The leg-receiving tube 1 is a connector used to receive a leg of a table, chair, or other piece of furniture. The foot 2 is the segment of the present invention that contacts the ground, enabling the present invention to adapt to various inclines and surface textures. The ball-and-socket joint 5 is a connector that allows for movement of the ball side relative to the socket side but does not allow for translational movement of the different sides. The incremental height-adjustment mechanism 6 is a system that allows the user to modify the height of a received leg of a chair, table, or other piece of furniture above the ground, thus allowing the incremental height-adjustment mechanism 6 to modify the length or height of the received leg of a chair, table, or other piece of furniture above the ground. The plurality of ground-gripping protrusions 11 is a series of extended segments that mechanically connect to the ground during use. These components combine to provide the present invention with the ability to properly arrange a chair or table leg.

Figure 2:
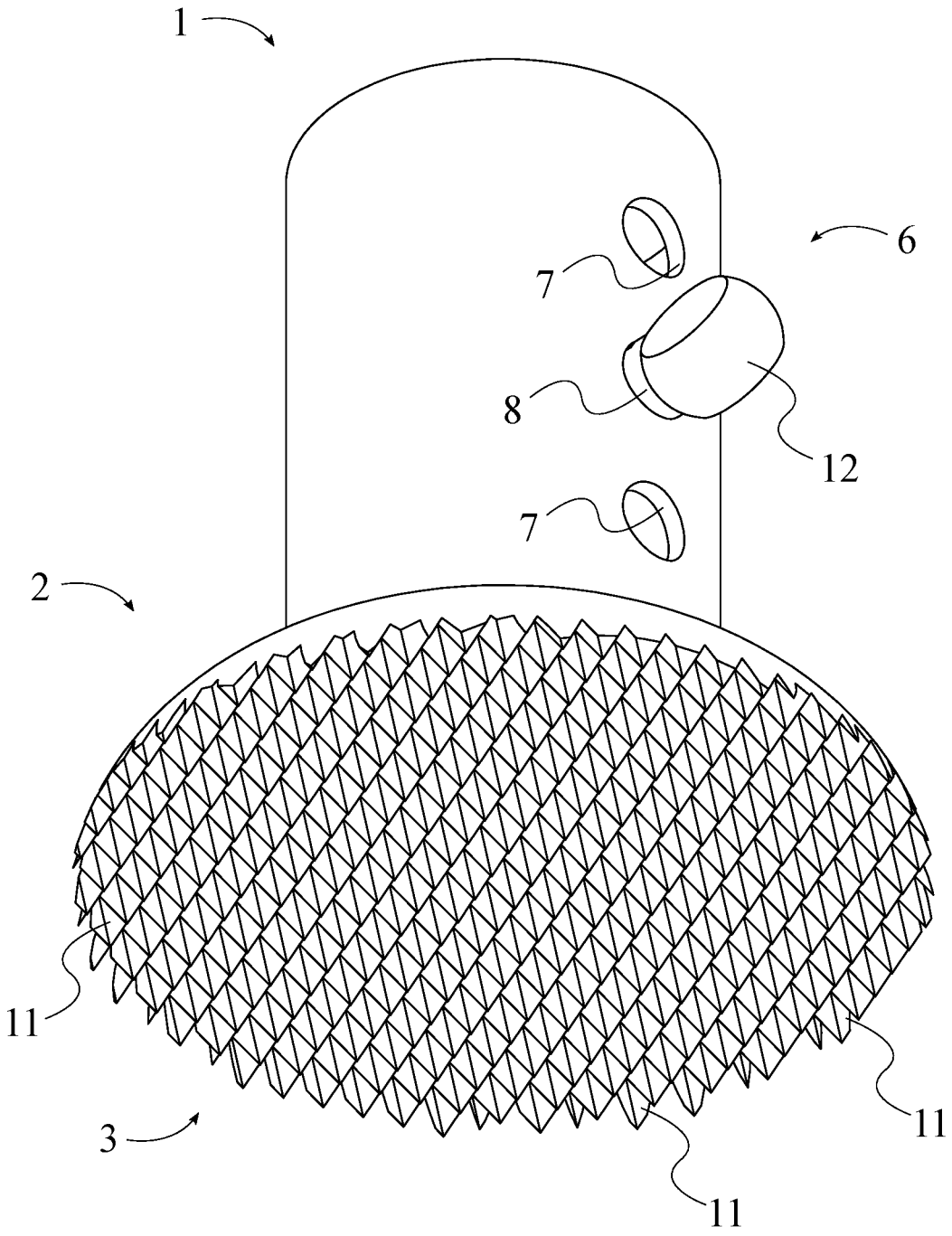
FIG. 2 is a bottom perspective view of the present invention.

The general configuration of the aforementioned components allows the present invention to efficiently and effectively position a table or chair leg to stabilize the leg, as well as to prevent the furniture from sliding of shifting during use. The foot 2 comprises a first side 3 and a second side 4. This arrangement allows for orientation of the foot 2 relative to the ball-and-socket joint 5. The first side 3 and the second side 4 are positioned opposite each other about the foot 2. In this way, the first side 3 and the second side 4 allow for relative positioning of subsequent components. The plurality of ground-gripping protrusions 11 is integrated into the first side 3. Further, the plurality of ground-gripping protrusions 11 is distributed across the first side 3, as seen in FIG. 2. This arrangement allows the first side 3 to grasp the ground during use with the plurality of ground-gripping protrusions 11. The second side 4 is terminally and pivotably mounted to the leg-receiving tube 1 by the ball-and-socket joint 5. In this way, the second side 4 can pivot relative to the leg-receiving tube 1. Furthermore, the incremental height-adjustment mechanism 6 is operatively integrated along the leg-receiving tube 1, wherein the incremental height-adjustment mechanism 6 is used to adjust a leg-receiving depth of the leg-receiving tube 1. This arrangement ensures that the present invention is equipped to adjust any table or chair to an appropriate height, thus preventing the chair or table from wobbling due to uneven legs.

The present invention must be able to prevent a table or chair from sliding down a rough or uneven surface. To this end, in an exemplary embodiment, the plurality of ground-gripping protrusions 11 is a knurled surface. This arrangement maximizes the available surface area to be utilized by the present invention in order to grip the ground or other surfaces. For example, the plurality of ground-gripping protrusions 11 may be a set of rubber or high-friction extrusions or nubs.

Figure 4:
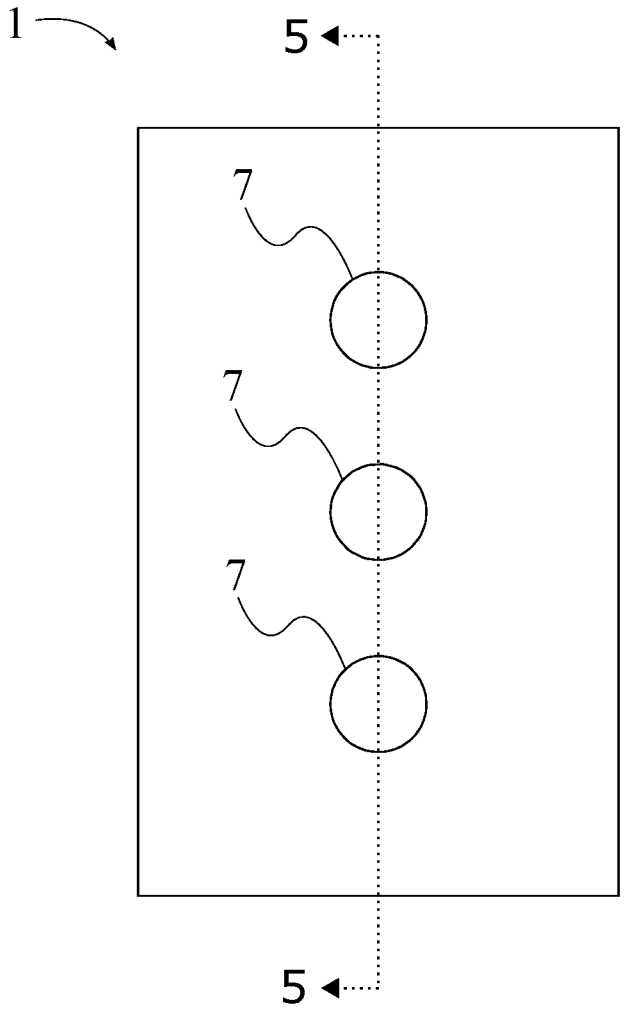
FIG. 4 is a front view of the leg-receiving tube.

The present invention requires a mechanism for adjusting the length of table and chair legs in order to ensure leg length is roughly equal around the table or chair. To this end, the incremental height-adjustment mechanism 6 comprises a plurality of transverse holes 7 and a peg 8. The plurality of transverse holes 7 is a set of preferably circular cuts through the leg-receiving tube 1. The peg 8 is a cylindrical extrusion that fits through the plurality of transverse holes 7. This arrangement allows the user to set the height of the leg of a table or chair at specific heights. The plurality of transverse holes 7 laterally traverses through the leg-receiving tube 1, as seen in FIG. 4. This ensures that the peg 8 can fit through one side of the leg-receiving tube 1 and out the other side. The peg 8 is engaged through a selected hole from the plurality of transverse holes 7. This arrangement provides a mechanism for controlling the length of the leg of a chair or table.

Figure 6:
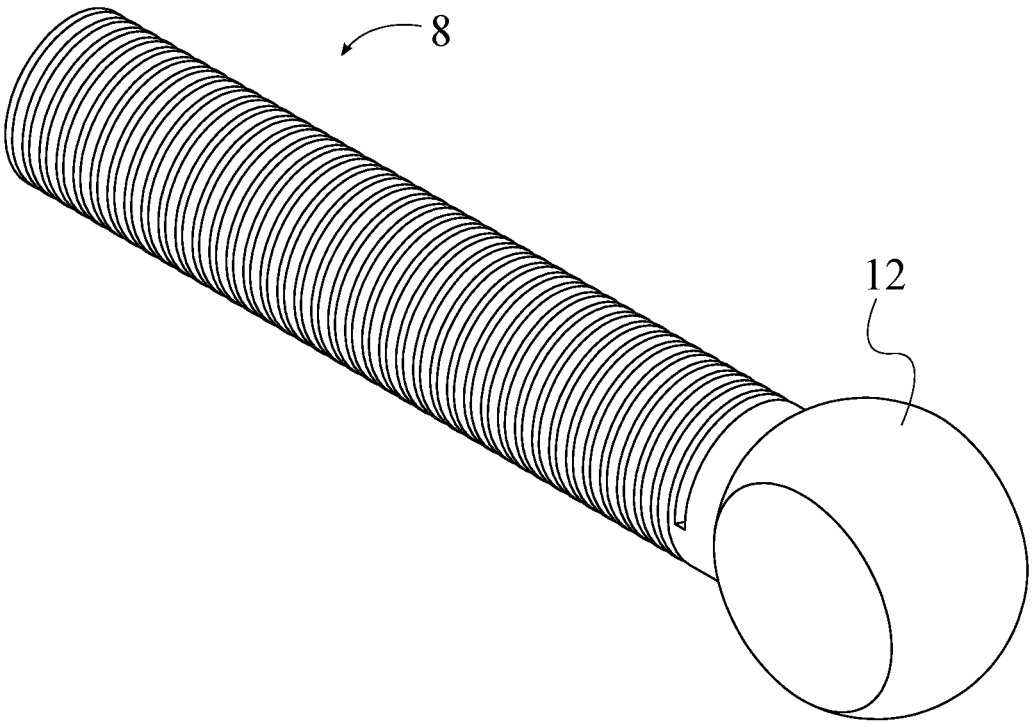
FIG. 6 is a perspective view of an embodiment of a threaded peg.
Figure 7:
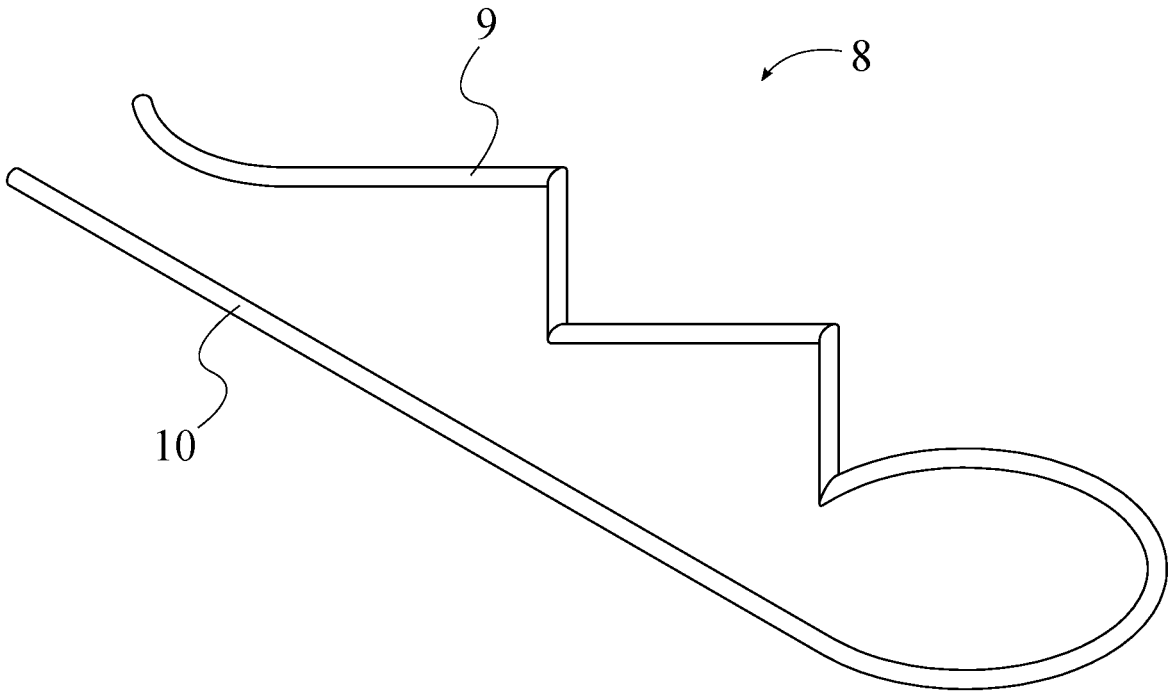
FIG. 7 is a perspective view of an embodiment of a hairpin peg.

In an exemplary embodiment, the user may wish to retain the height of the table or chair leg without worrying about the peg 8 falling or sliding out. To this end, the peg 8 is threadably engaged to a hole of the plurality of transverse holes 7, as seen in FIG. 6. This arrangement secures the peg 8 in place within the selected hole of the plurality of transverse holes 7. In an exemplary alternative embodiment, the user may wish to have greater control over the height of the table or chair leg within the present invention. To this end, in this embodiment, the peg 8 is a hairpin, as seen in FIG. 7. The hairpin comprises a step-shaped leg 9 and a straight leg 10. The step-shaped leg 9 is a zig-zag patterned support. The straight leg 10 is a support extending generally in the same direction as the step-shaped support, adjacent to the step-shaped support. The straight leg 10 is positioned in between the step-shaped leg 9 and the ball-and-socket joint 5. This arrangement allows the user to pull the peg 8 partially from the selected hole of the plurality of transverse holes 7 to adjust the height of the table or chair leg above the ball-and-socket joint 5 to distinct heights between adjacent holes of the plurality of transverse holes 7.

The user requires a way to adjust and reposition the peg 8. Accordingly, the present invention further comprises an eyelet 12, as seen in FIG. 6. The eyelet 12 is a generally circular or ring-shaped extrusion that provides a grasping surface for the user. The eyelet 12 is externally positioned to the leg-receiving tube 1. In this way, the eyelet 12 is always accessible to the user. Further, the eyelet 12 is terminally connected to the peg 8. This arrangement allows the user to grasp the eyelet 12 to pull or push the peg 8 into the leg-receiving tube 1.

Figure 5:
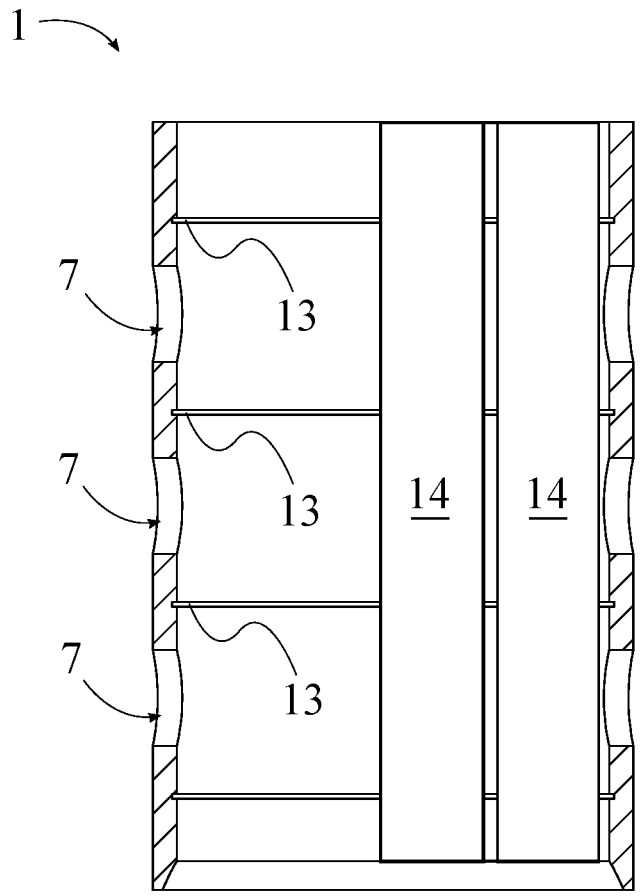
FIG. 5 is a cross-sectional view of the leg-receiving tube about line 5-5, wherein the leg-receiving tube is containing a plurality of space-filling members.

The leg may require additional support to keep it in place within the leg-receiving tube 1. To this end, the present invention comprises a plurality of annular grips 13. The plurality of annular grips 13 is a series of cuts or protrusions that help secure the table or chair leg in place, as seen in FIG. 5. The plurality of annular grips 13 is concentrically positioned within the leg-receiving tube 1. This arrangement provides adequate leverage for the plurality of annular grips 13 to connect or contact the table or chair leg. Further, the plurality of annular grips 13 is distributed along the leg-receiving tube 1. This arrangement provides ample coverage of the leg-receiving tube 1 with the plurality of annular grips 13.

During use, the user may find that the present invention generates a small amount of excess space around the leg of a contained chair or table. To this end, the present invention comprises a plurality of space-filling members 14, as seen in FIG. 5. The plurality of space-filling members 14 is a set of objects that can fill any excess space within the present invention during use. The plurality of space-filling members 14 is positioned within the leg-receiving tube 1. This arrangement allows the plurality of space-filling members 14 to surround loose area around the contained leg of a chair or table. The plurality of space-filling members 14 is positioned along the leg-receiving tube 1. In this way, the plurality of space-filling members 14 fills the volume around the contained leg, thus preventing any undesirable motion of the leg.

Several specific materials are preferred for their mechanical properties, including but not limited to optimal rigidity, toughness, and fatigue resistance. The leg-receiving tube 1 is preferably made of any of a variety of metallic materials. The plurality of space-filling members 14 is preferably made of metal, but may also be made of expanding material, which would more completely fill any empty volume within the leg-receiving tube 1. The present invention may further be integrated on furniture as part of the body of contained furniture legs.

Although the invention has been explained in relation to its preferred embodiment, it is to be understood that many other possible modifications and variations can be made without departing from the spirit and scope of the invention as hereinafter claimed.

What is claimed is:

1. A furniture leg attachment comprises:

a leg-receiving tube;

a foot;

a ball-and-socket joint;

an incremental height-adjustment mechanism;

a plurality of ground-gripping protrusions;

the foot comprises a first side and second side;

the first side and the second side being positioned opposite to each other about the foot;

the plurality of ground-gripping protrusions being integrated into the first side;

the plurality of ground-gripping protrusions being distributed across the first side;

the second side being terminally and pivotably mounted to the leg-receiving tube by the ball-and-socket joint; and the incremental height-adjustment mechanism being operatively integrated along the leg-receiving tube, wherein the incremental height-adjustment mechanism is used to adjust a leg-receiving depth of the leg-receiving tube.

2. The furniture leg attachment as claimed in claim 1, wherein the plurality of ground-gripping protrusions is a knurled surface.

3. The furniture leg attachment as claimed in claim 1 comprises:

the incremental height-adjustment mechanism comprises a plurality of transverse holes and a peg;

the plurality of transverse holes laterally traversing through the leg-receiving tube; and the peg being engaged through a selected hole from the plurality of transverse holes.

4. The furniture leg attachment as claimed in claim 3 comprises:

the peg being threadably engaged to the selected hole.

5. The furniture leg attachment as claimed in claim 3 comprises:

the peg being a hairpin;

the hairpin comprises a step-shaped leg and a straight leg; and the straight leg being positioned in between the step-shaped leg and the ball-and-socket joint.

6. The furniture leg attachment as claimed in claim 3 comprises:

an eyelet;

the eyelet being externally positioned to the leg-receiving tube; and the eyelet being terminally connected to the peg.

7. The furniture leg attachment as claimed in claim 1 comprises:

a plurality of annular grips;

the plurality of annular grips being concentrically positioned within the leg-receiving tube; and the plurality of annular grips being distributed along the leg-receiving tube.

8. The furniture leg attachment as claimed in claim 1 comprises:

a plurality of space-filling members;

the plurality of space-filling members being positioned within the leg-receiving tube; and the plurality of space-filling members being positioned along the leg-receiving tube.

9. A furniture leg attachment comprises:

a leg-receiving tube;

a foot;

a ball-and-socket joint;

an incremental height-adjustment mechanism;

a plurality of ground-gripping protrusions;

the foot comprises a first side and second side;

the incremental height-adjustment mechanism comprises a plurality of transverse holes and a peg;

the first side and the second side being positioned opposite to each other about the foot;

the plurality of ground-gripping protrusions being integrated into the first side;

the plurality of ground-gripping protrusions being distributed across the first side;

the second side being terminally and pivotably mounted to the leg-receiving tube by the ball-and-socket joint;

the incremental height-adjustment mechanism being operatively integrated along the leg-receiving tube, wherein the incremental height-adjustment mechanism is used to adjust a leg-receiving depth of the leg-receiving tube;

the plurality of transverse holes laterally traversing through the leg-receiving tube; and the peg being engaged through a selected hole from the plurality of transverse holes.

10. The furniture leg attachment as claimed in claim 9, wherein the plurality of ground-gripping protrusions is a knurled surface.

11. The furniture leg attachment as claimed in claim 9 comprises:

the peg being threadably engaged to the selected hole.

12. The furniture leg attachment as claimed in claim 9 comprises:

the peg being a hairpin;

the hairpin comprises a step-shaped leg and a straight leg; and the straight leg being positioned in between the step-shaped leg and the ball-and-socket joint.

13. The furniture leg attachment as claimed in claim 9 comprises:

an eyelet;

the eyelet being externally positioned to the leg-receiving tube; and the eyelet being terminally connected to the peg.

14. The furniture leg attachment as claimed in claim 9 comprises:

a plurality of annular grips;

the plurality of annular grips being concentrically positioned within the leg-receiving tube; and the plurality of annular grips being distributed along the leg-receiving tube.

15. The furniture leg attachment as claimed in claim 9 comprises:

a plurality of space-filling members;

the plurality of space-filling members being positioned within the leg-receiving tube; and the plurality of space-filling members being positioned along the leg-receiving tube.

16. A furniture leg attachment comprises:

a leg-receiving tube;

a foot;

a ball-and-socket joint;

an incremental height-adjustment mechanism;

a plurality of ground-gripping protrusions;

a plurality of annular grips;

the foot comprises a first side and second side;

the first side and the second side being positioned opposite to each other about the foot;

the plurality of ground-gripping protrusions being integrated into the first side;

the plurality of ground-gripping protrusions being distributed across the first side;

the second side being terminally and pivotably mounted to the leg-receiving tube by the ball-and-socket joint;

the incremental height-adjustment mechanism being operatively integrated along the leg-receiving tube, wherein the incremental height-adjustment mechanism is used to adjust a leg-receiving depth of the leg-receiving tube;

the plurality of ground-gripping protrusions is a knurled surface;

the plurality of annular grips being concentrically positioned within the leg-receiving tube; and the plurality of annular grips being distributed along the leg-receiving tube.

17. The furniture leg attachment as claimed in claim 16 comprises:

an eyelet;

the incremental height-adjustment mechanism comprises a plurality of transverse holes and a peg;

the plurality of transverse holes laterally traversing through the leg-receiving tube; and the peg being engaged through a selected hole from the plurality of transverse holes.

18. The furniture leg attachment as claimed in claim 17 comprises:

the peg being threadably engaged to the selected hole;

the eyelet being externally positioned to the leg-receiving tube; and the eyelet being terminally connected to the peg.

19. The furniture leg attachment as claimed in claim 17 comprises:

the peg being a hairpin;

the hairpin comprises a step-shaped leg and a straight leg; and the straight leg being positioned in between the step-shaped leg and the ball-and-socket joint.

20. The furniture leg attachment as claimed in claim 16 comprises:

a plurality of space-filling members;

the plurality of space-filling members being positioned within the leg-receiving tube; and the plurality of space-filling members being positioned along the leg-receiving tube.

* * * * *